US012448671B2

(12) United States Patent
Sandoval Ravotti et al.

(10) Patent No.: US 12,448,671 B2
(45) Date of Patent: Oct. 21, 2025

(54) CEMENTED CARBIDE COMPOSITIONS

(71) Applicant: Hyperion Materials & Technologies, Inc., Worthington, OH (US)

(72) Inventors: Daniela Andreina Sandoval Ravotti, Mollet del Vallès (ES); Olivier Ther, Sant Fost Campsentelles (ES); Luis Fernando Garcia, Barcelona (ES); Olivier Lavigne, Barcelona (ES)

(73) Assignee: HYPERION MATERIALS & TECHNOLOGIES, INC., Worthington, OH (US)

( * ) Notice: Subject to any disclaimer, the term of this patent is extended or adjusted under 35 U.S.C. 154(b) by 0 days.

(21) Appl. No.: 18/706,559

(22) PCT Filed: Dec. 14, 2022

(86) PCT No.: PCT/US2022/081496
§ 371 (c)(1),
(2) Date: May 1, 2024

(87) PCT Pub. No.: WO2023/136954
PCT Pub. Date: Jul. 20, 2023

(65) Prior Publication Data

US 2025/0171883 A1 May 29, 2025

Related U.S. Application Data

(60) Provisional application No. 63/298,677, filed on Jan. 12, 2022.

(51) Int. Cl.

| | |
|---|---|
| ***C22C 29/08*** | (2006.01) |
| ***C22C 1/051*** | (2023.01) |
| ***C22C 29/00*** | (2006.01) |

(52) U.S. Cl.
CPC ..... *C22C 29/08* (2013.01); *C22C 1/051* (2013.01); *C22C 29/005* (2013.01)

(58) Field of Classification Search
CPC ..... C22C 29/08
See application file for complete search history.

(56) References Cited

U.S. PATENT DOCUMENTS

| | | | | |
|---|---|---|---|---|
| 6,869,460 | B1 * | 3/2005 | Bennett | C22C 29/08 75/242 |
| 2005/0126336 | A1 * | 6/2005 | Jansson | C23C 30/005 75/240 |

FOREIGN PATENT DOCUMENTS

| | | |
|---|---|---|
| CN | 108034878 A | 5/2018 |
| EP | 1216314 B1 | 5/2007 |

(Continued)

OTHER PUBLICATIONS

Wei Su et al., "Effects of TaC on microstructure and mechanical properties of coarse grained WC—9Co cemented carbides", Trans. Nonferrous Met. Soc. China, vol. 25, 2015, pp. 1194-1199.

(Continued)

*Primary Examiner* — Christopher S Kessler
(74) *Attorney, Agent, or Firm* — Ari G. Zytcer

(57) ABSTRACT

Provided is a cemented carbide composition having a hard phase made of tungsten carbide (WC) as a first hard phase component and at least one second hard phase component selected from the group consisting of tantalum carbide (TaC), niobium carbide (NbC), and mixtures thereof, and a binder phase made of at least one binder component selected from the group consisting of cobalt (Co), nickel (Ni), and mixtures thereof. Also provided is a cemented carbide composition having a hard phase made of WC as a hard phase, NbC as an anti-galling phase, and TaC as a toughness improver, and a binder phase made of at least one binder component selected from the group consisting of Co, Ni, and (Continued)

mixtures thereof. Associated methods of producing the cemented carbide compositions and tools incorporating the same are additionally contemplated.

18 Claims, 9 Drawing Sheets

(56) References Cited

FOREIGN PATENT DOCUMENTS

| | | | | |
|---|---|---|---|---|
| JP | S5635745 | A | 4/1981 | |
| JP | 2000308904 | A | 11/2000 | |
| JP | 2021130862 | A | 9/2021 | |
| WO | WO-2020152291 | A1 * | 7/2020 | ..... B22F 3/14 |

OTHER PUBLICATIONS

Su Wei et al. "Effects of TacCon microstructure and mechanical properties of coarse grained WC—9Co cemented carbides", Transactions of Nonferrous Metals Society of China, Elsevier, Amsterdam, NL, vol. 25, No. 4, May 6, 2015, pp. 1194-1199.

* cited by examiner

CEMENTED CARBIDE COMPOSITIONS

This is a National Phase Application filed under 35 U.S.C. 371 as the national stage of PCT/US2022/81496 filed on Dec. 14, 2022, an application claiming the benefit of U.S. Application No. 63/298,677 filed on Jan. 12, 2022, the entire content, of which, is hereby incorporated by reference in its entirety.

FIELD OF THE DISCLOSURE

The present application relates to cemented carbide compositions having improved properties, such as improved galling resistance, a low friction coefficient, and a good hardness/toughness ratio. Additionally, the present application relates to implementations of the cemented carbide compositions, methods of producing the cemented carbide compositions and tools incorporating the same.

BACKGROUND

Cemented carbide compositions are commonly used metallurgical products due to their hardness and toughness. The combination of good hardness and toughness makes cemented carbide compositions good candidates for applications that involve significant amounts of wear, such as materials processing, tool inserts, structural components, etc. In general, cemented carbide compositions have a hard phase containing hard constituents, such as refractory carbides, nitrides, carbonitrides, borides, etc. Cemented carbide compositions also generally have a binder phase that contains a ductile metallic binder, such as cobalt (Co), nickel (Ni), iron (Fe), etc. The hard phase and a metallic binder phase can be processed into a wide variety of microstructures that achieve different mechanical and physical properties. Moreover, additional components can be added to the composition to help control and refine the properties achieved by cemented carbide compositions. For example, grain growth inhibitors (e.g., Cr) can be added to influence the tungsten carbide (WC) grain growth during processing and cubic carbides (e.g., titanium carbide, TiC and tantalum carbide, TaC) can be added to provide additional hardness.

WC is a commonly used hard phase component in cemented carbide compositions, especially in tungsten carbide-cobalt (i.e. WC—Co) systems. However, WC supplies have started to become increasingly limited due to the popularity of WC carbides and the global growth of the tungsten processing industry. As a result of the limited supply and increased demand, the cost of WC has risen and may continue to rise. The industry, therefore, is desirous of alternatives to WC that still maintain good properties but avoid or reduce the reliance on tungsten supplies and other critical raw materials in the cemented carbide compositions industry.

As the result of diligent studies, the inventors discovered that it is acceptable to partially substitute WC with niobium carbide (NbC) and/or TaC and achieve such good properties. Even though Nb and Ta may be more expensive than W currently, and Nb resources exceed the ones of W, the use of Nb and Ta provides flexibility, such that excellent cemented carbide compositions can be produced in the event of a W shortage or a price increase. Moreover, by maintaining a homogenous microstructure, the partial substitution of WC with NbC and/or TaC combines the good galling resistance of the NbC and TaC with the elevated resistance of WC—Co cemented carbide compositions. Thus, the inventors' discovery decreases the use of critical raw materials and reduces the influence of market fluctuations, while maintaining excellent properties for the cemented carbide compositions, such as an improved galling resistance, a low friction coefficient, and a good hardness/toughness ratio.

SUMMARY

In view of the above-mentioned exemplary problems with conventional and known cemented carbide compositions, the present application provides new and improved cemented carbide compositions.

An embodiment of the present application includes a cemented carbide composition having a hard phase including tungsten carbide (WC) as a first hard phase component and at least one second hard phase component selected from the group consisting of tantalum carbide (TaC), niobium carbide (NbC), and mixtures thereof, and a binder phase including at least one binder selected from the group consisting of Co, Ni, and mixtures thereof. The cemented carbide composition includes from 10 wt. % to 30 wt. % of the at least one second hard phase component selected from the group consisting of TaC and NbC based on the total weight of the cemented carbide composition.

In one embodiment, the cemented carbide composition further includes a grain growth inhibitor.

In one embodiment, the grain growth inhibitor is molybdenum carbide ($Mo_2C$).

In one embodiment, the cemented carbide composition includes from 69 wt. % to 74 wt. % of the WC as the first hard phase component based on the total weight of the cemented carbide composition.

In one embodiment, the cemented carbide composition includes from 9 wt. % to 10 wt. % of the at least one binder based on the total weight of the cemented carbide composition.

In one embodiment, the cemented carbide composition includes from approximately 0.5 wt. % to approximately 1.5 wt. % of the grain growth inhibitor based on the total weight of the cemented carbide composition.

In one embodiment, the cemented carbide composition has a hardness HV30 of from 1450 to 1600.

In one embodiment, the cemented carbide composition has a fracture toughness $K_{Ic}$ of from 8.5 to 10 MPa√m.

Another embodiment of the present application includes a cemented carbide composition having a hard phase including tungsten carbide (WC) as a hard phase, niobium carbide (NbC) as an anti-galling phase, and tantalum carbide (TaC) as a toughness improver, and a binder phase including at least one binder selected from the group consisting of cobalt (Co), nickel (Ni), and mixtures thereof. The cemented carbide composition includes from 10 wt. % to 30 wt. % of the NbC as the anti-galling phase based on the total weight of the cemented carbide composition.

In one embodiment, the cemented carbide composition further includes a grain growth inhibitor.

In one embodiment, the cemented carbide composition includes at least one grain growth inhibitor selected from the group consisting of molybdenum (Mo), molybdenum carbide (MoC), molybdenum carbide ($Mo_2C$), chromium carbide ($Cr_3C_2$), and mixtures thereof.

In one embodiment, the cemented carbide composition includes a balance of the WC as the hard phase.

In one embodiment, the cemented carbide composition includes from approximately 0.3 wt. % to 9 wt. % of the TaC as the toughness improver based on the total weight of the cemented carbide composition.

In one embodiment, the cemented carbide composition includes from 5 wt. % to 15 wt. % of the at least one binder based on the total weight of the cemented carbide composition.

In one embodiment, the cemented carbide composition includes as the grain growth inhibitor, approximately from 0.5 wt. % to 3 wt. % of at least one component selected from the group consisting of Mo, MoC, $Mo_2C$, a mixture thereof based on the total weight of the cemented carbide composition, and optionally, approximately from 0.1 wt. % to approximately 1.5 wt. % of $Cr_3C_2$ based on the total weight of the cemented carbide composition.

Another embodiment of the present application includes a tool including the cemented carbide compositions disclosed herein.

Another embodiment of the present application includes a method of making a cemented carbide including: (a) providing a batch of powdered raw materials including tungsten carbide (WC) as a first hard phase component, a binder including at least one component selected from the group consisting of cobalt (Co), nickel (Ni), and mixtures thereof, at least one component selected from the group consisting of tantalum carbide (TaC), niobium carbide (NbC), and mixtures thereof as a second hard phase component, and a grain growth inhibitor; (b) pressing the batch of powdered raw materials to form a pre-compact; and (c) sintering the pre-compact. The cemented carbide includes from 10 wt. % to 30 wt. % of the NbC as an anti-galling phase based on the total weight of the cemented carbide.

Other systems, methods, features and advantages will be, or will become, apparent to one with skill in the art upon examination of the following figures and detailed description. It is intended that all such additional systems, methods, features and advantages be included within this description, be within the scope of the present disclosure, and be protected by the following claims. Nothing in this section should be taken as a limitation on those claims. Further aspects and advantages are discussed below in conjunction with the embodiments of the disclosure. It is to be understood that both the foregoing general description and the following detailed description of the present disclosure are examples and explanatory and are intended to provide further explanation of the disclosure as claimed.

BRIEF DESCRIPTION OF THE DRAWINGS

The accompanying drawings, which are included to provide a further understanding of the subject matter and are incorporated in and constitute a part of this specification, illustrate implementations of the subject matter and together with the description serve to explain the principles of the disclosure.

DETAILED DESCRIPTION

Figure 1:
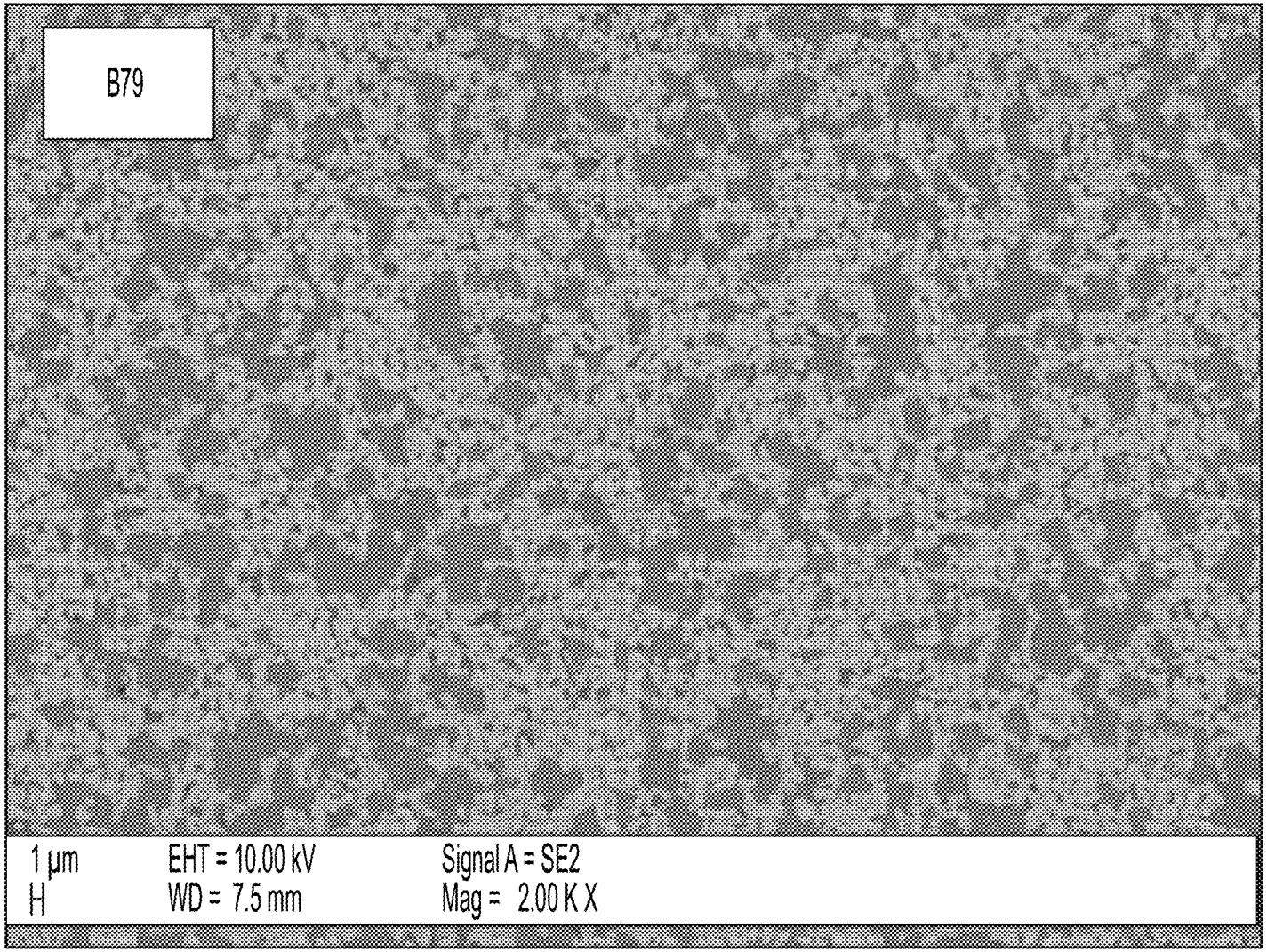
FIG. 1 is a scanning electron microscope (SEM) image of a first embodiment of a microstructure of a cemented carbide composition of the present application shown at a 2000× magnification.
Figure 2:
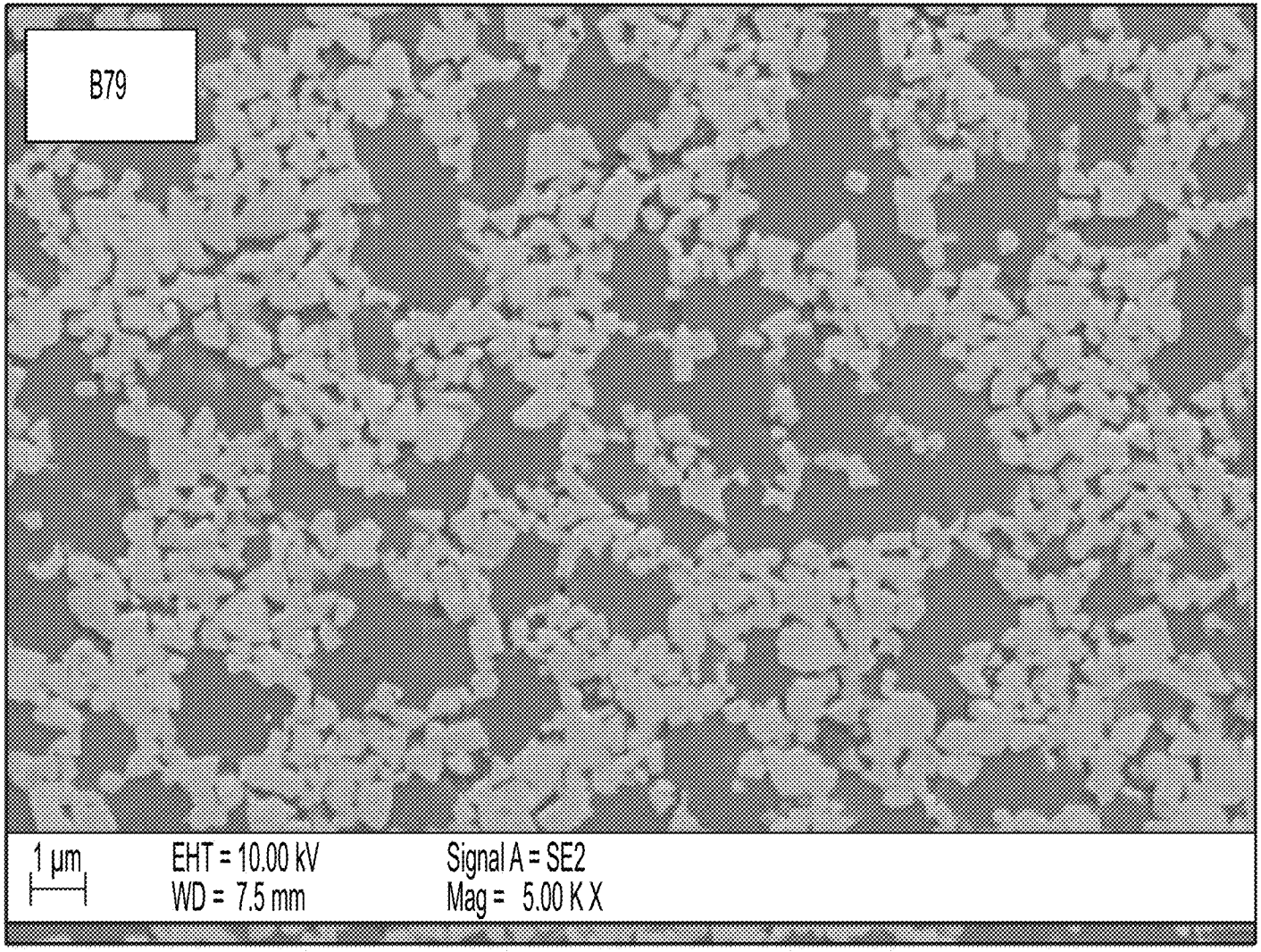
FIG. 2 is a scanning electron microscope (SEM) image of the first embodiment of a microstructure of the cemented carbide composition of the present application shown at a 5000× magnification.
Figure 3:
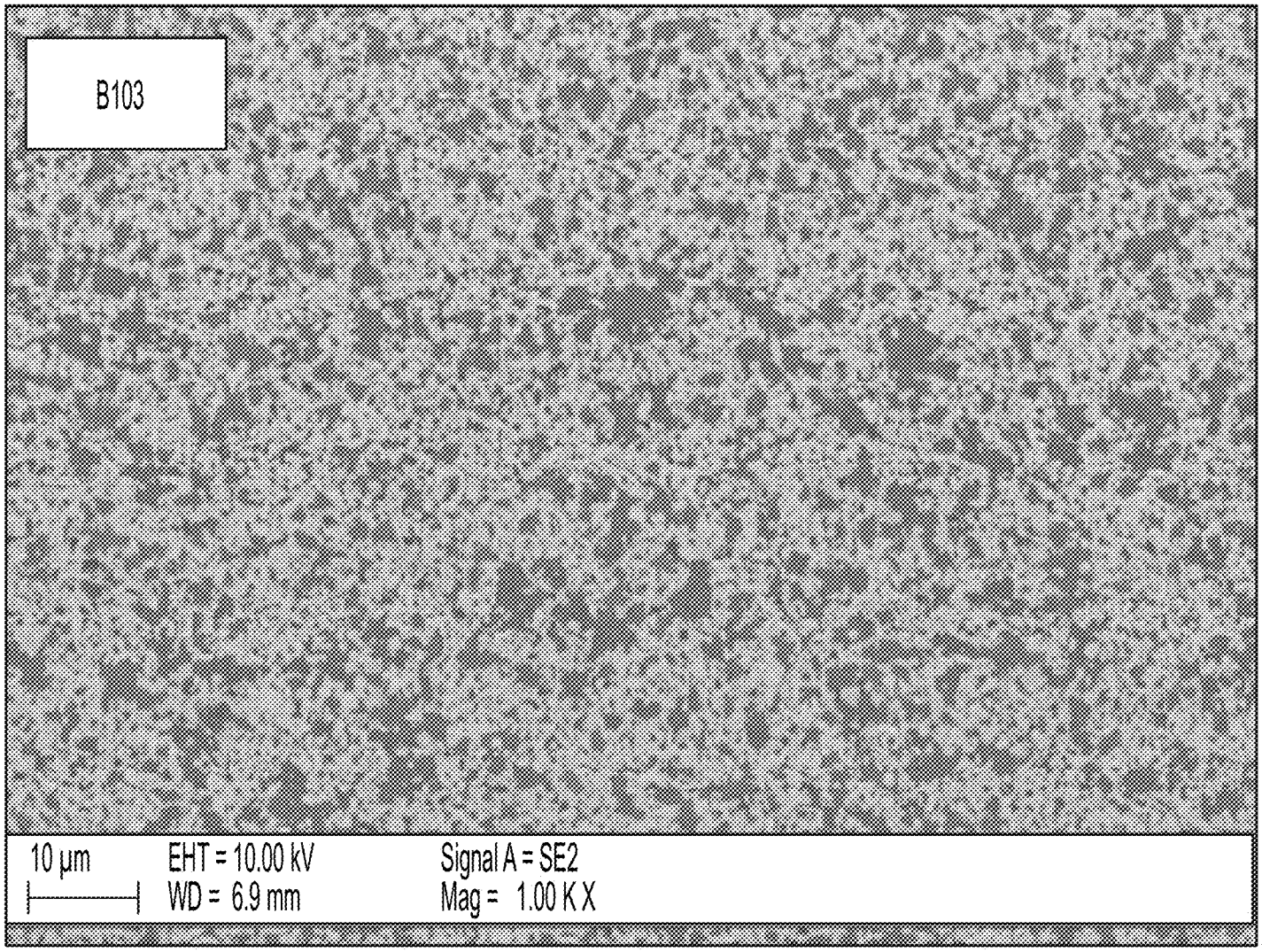
FIG. 3 is a scanning electron microscope (SEM) image of a second embodiment of a microstructure of a cemented carbide composition of the present application shown at a 2000× magnification.
Figure 4:
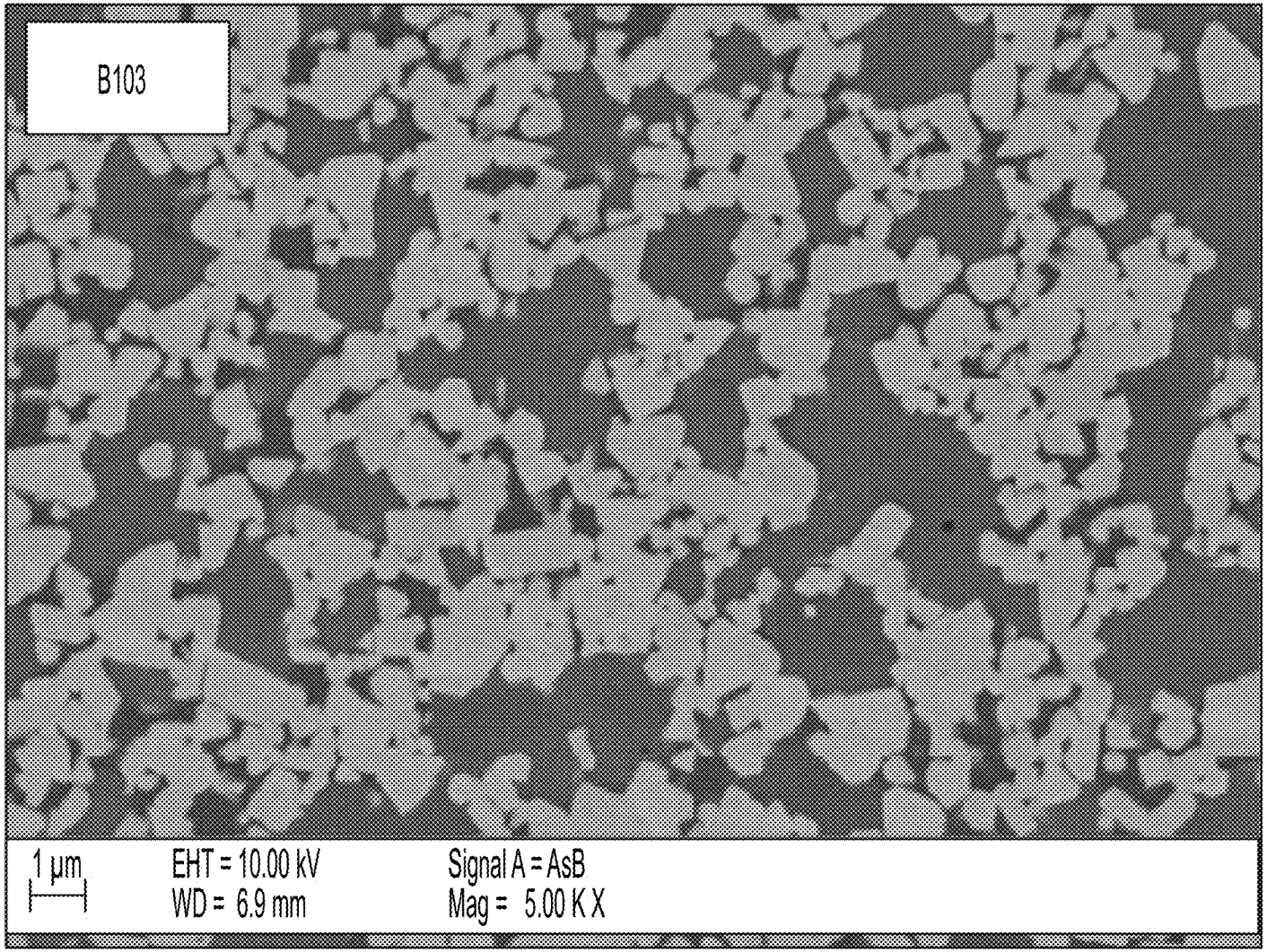
FIG. 4 is a scanning electron microscope (SEM) image of the second embodiment of a microstructure of the cemented carbide composition of the present application shown at a 5000× magnification.
Figure 5:
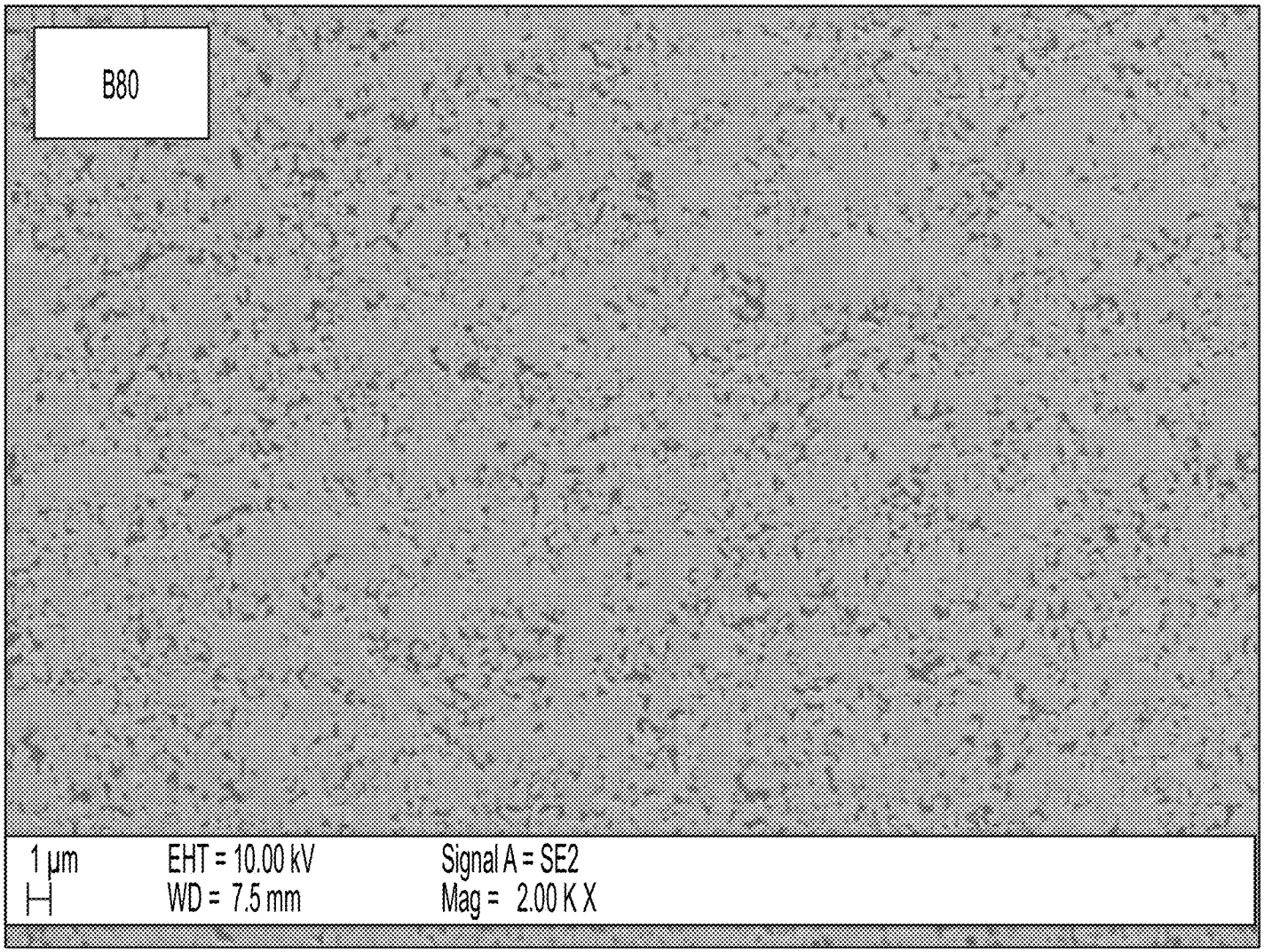
FIG. 5 is a scanning electron microscope (SEM) image of a third embodiment of a microstructure of a cemented carbide composition of the present application shown at a 2000× magnification.
Figure 6:
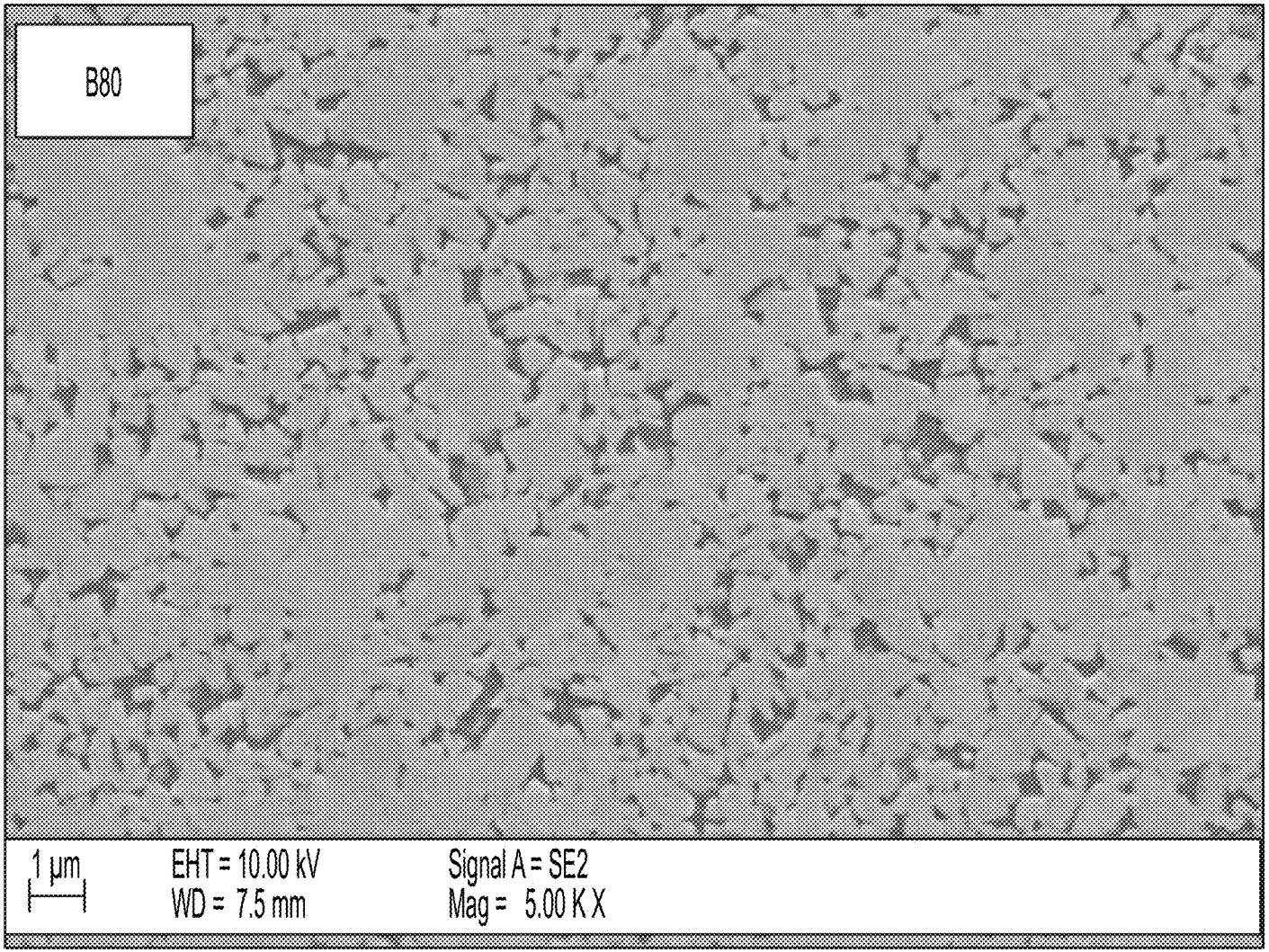
FIG. 6 is a scanning electron microscope (SEM) image of the third embodiment of a microstructure the cemented carbide composition of the present application shown at a 5000× magnification.

Unless defined otherwise all technical and scientific terms used herein have the same meaning as commonly understood to one of ordinary skill in the art to which the presently described subject matter pertains.

Where a range of values is provided, for example, concentration ranges, percentage ranges, or ratio ranges, it is understood that each intervening value, to the tenth of the unit of the lower limit, unless the context clearly dictates otherwise, between the upper and lower limit of that range and any other stated or intervening value in that stated range, is encompassed within the described subject matter. The upper and lower limits of these smaller ranges may independently be included in the smaller ranges, and such embodiments are also encompassed within the described subject matter, subject to any specifically excluded limit in the stated range. Where the stated range includes one or both of the limits, ranges excluding either or both of those included limits are also included in the described subject matter.

The following definitions set forth the parameters of the described subject matter.

As used herein this disclosure, "wt. %" refers to a given weight percent based on the total weight of the cemented carbide composition, unless specifically indicated otherwise.

As used herein this disclosure, the term "D50" refers to a particle size corresponding to 50% of the volume of the sampled particles being smaller than and 50% of the volume of the sampled particles being greater than the recited D50 value. Similarly, the term "D90" refers to a particle size corresponding to 90% of the volume of the sampled particles being smaller than and 10% of the volume of the sampled particles being greater than the recited D90 value. The term "D10" refers to a particle size corresponding to 10% of the volume of the sampled particles being smaller than and 90% of the volume of the sampled particles being greater than the recited D10 value. A width of the particle size distribution can be calculated by determining the span, which is defined by the equation (D90-D10)/D50. The span gives an indication of how far the 10 percent and the 90 percent points are apart normalized with the midpoint.

To determine mean particle sizes from a given particle size distribution, a skilled artisan would be readily familiar with the ISO 4499-2:2008 standard. The ISO 4499-2:2008 standard provides guidelines for the measurement of hardmetal grain size by metallographic techniques using optical or electron microscopy. It is intended for sintered WC/Co hardmetals containing primarily WC as the hard phase. It is also intended for measuring the grain size and distribution by a linear-intercept technique.

To further supplement the ISO 4499-2:2008 standard, a skilled artisan would equally know about the ASTM B390-92 (2006) standard. This standard is used for visual comparison and classification of the apparent grain size and distribution of cemented tungsten carbides that typically contain cobalt as a metallic binder in the binder phase.

Cemented carbide grades can be classified according to the grain size. Different types of grades have been defined as nano, ultrafine, submicron, fine, medium, medium coarse, coarse and extra coarse. As used herein this disclosure, the term (I) "nano grade" is defined as a material with a grain size of less than about 0.2 μm; (II) "ultrafine grade" is defined as a material with a grain size from about 0.2 μm to about 0.5 μm; (III) "submicron grade" is defined as a material with a grain size from about 0.5 μm to about 0.9 μm; (IV) "fine grade" is defined as a material with a grain size from about 1.0 μm to about 1.3 μm; (V) "medium grade" is defined as a material with a grain size from about 1.4 μm to about 2.0 μm; (VI) "medium coarse grade" is defined as a material with a grain size from about 2.1 μm to about 3.4 μm; (VII) "coarse grade" is defined as a material with a grain size from about 3.5 μm to about 5.0 μm; and (VIII) "extra coarse grade" is defined as a material with a grain size greater than about 5.0 μm.

As used herein this disclosure, the terms "about" and "approximately" are used interchangeably. It is meant to mean plus or minus 1% of the numerical value of the number with which it is being used. Thus, "about" and "approximately" are used to provide flexibility to a numerical range endpoint by providing that a given value may be "above" or "below" the given value. As such, for example a value of 50% is intended to encompass a range defined by 49.5%-50.5%.

As used herein this disclosure, the term "predominantly" is meant to encompass at least 95% of a given entity.

Wherever used throughout the disclosure, the term "generally" has the meaning of "approximately", "typically" or "closely" or "within the vicinity or range of".

As used herein, the term "substantially" refers to the complete or nearly complete extent or degree of an action, characteristic, property, state, structure, item, or result.

As used herein this disclosure, the term "green body" refers to the material in the form of bonded powder or plates before the material has physically been sintered.

As used herein this disclosure, the term "coefficient of friction" i.e. μ is a ratio that is used to quantify the (I) frictional force resisting the motion of two surfaces in contact between two objects, that is taken in relation to the (II) normal force that is pressing and keeping the two objects together.

As used herein this disclosure, the term "galling" is a form of wear of a material typically caused by friction and adhesion between sliding surfaces. When a material galls, some of it is pulled with the contacting surface, especially if there is a large amount of force compressing the surfaces together. Thus, galling is caused by a combination of friction and adhesion between the surfaces that is followed by slipping and tearing of crystal structures beneath the surfaces. This will generally leave some material stuck or even friction-welded to the adjacent surface, whereas the galled material may appear gouged with balled-up or torn lumps of material stuck to its surface.

As used herein this disclosure, the term "green body" refers to the material in the form of bonded powder or plates before the material has physically been sintered.

As used herein this disclosure, the term "Palmqvist fracture toughness" i.e. $K_{Ic}$, refers to the ability of a material with pre-cracks to resist further fracture propagation upon absorbing energy.

As used herein this disclosure, the term "HV30 Vickers hardness" (i.e. applying a 30 kgf load) is a measure of the resistance to localized plastic deformation, which is obtained by indenting the sample with a Vickers tip at 30 kgf.

As used herein this disclosure, the ISO 28079-2009 standard specifies a method for measuring the fracture toughness and the hardness of hardmetals, cemented carbide compositions and cermets at room temperature by an indentation method. The ISO 28079-2009 standard applies to a measurement of the fracture toughness and hardness calculated by using the diagonal lengths of indentations and cracks emanating from the corners of a Vickers hardness indentation, and it is intended for use with metal-bonded carbides and carbonitrides (e.g. hardmetals, cermets or cemented carbide compositions). The test procedures proposed in the ISO 28079-2009 standard are intended for use at ambient temperatures but can be extended to higher or lower temperatures by agreement. The test procedures proposed in the ISO 28079-2009 standard are also intended for use in a normal laboratory-air environment. They are typically not intended for use in corrosive environments, such as strong acids or seawater. The ISO 28079-2009 standard is directly comparable to the standard ASTM B771 as disclosed for example in "Comprehensive Hard Materials book", 2014, Elsevier Ltd. Page 312, which is incorporated herein by reference in its entirety. Thus, it can be assumed that the measured fracture toughness and the hardness using the ISO 28079-2009 standard will be the same as the measured values employing the ASTM B771 standard.

The cemented carbide compositions of the present application are now described by reference to the embodiments. The description provided herein is not intended to limit the scope of the claims, but to exemplify the variety encompassed by the present application. The embodiments are described more fully hereinafter with reference to the accompanying drawings in which like numerals represent like elements throughout the several figures, and in which example embodiments are shown. Embodiments of the claims may, however, be embodied in many different forms and should not be construed as limited to the embodiments set forth herein. The examples set forth herein are non-limiting examples and are merely examples among other possible examples.

Cemented Carbide Compositions

According to a first embodiment, the present application includes cemented carbide compositions that partially substitute TaC, NbC, and mixtures thereof for WC. The cemented carbide compositions include a hard phase including WC as a first hard phase component and at least one second hard phase component selected from the group consisting of TaC, NbC, and mixtures thereof. Also, the cemented carbide compositions include a binder phase including at least one binder component selected from the group consisting of Co, Ni, and mixtures thereof. The hard phase partially substitutes a portion of the WC with TaC and/or NbC and achieves good properties by combining the good galling resistance of the NbC and TaC with the elevated resistance of WC—Co cemented carbide compositions. The combination of WC and NbC and/or TaC as the hard phase exhibits a homogeneous microstructure that contributes to maintaining the resistance of the material, while also improving the galling resistance with metallic alloys. As discussed above, the substitution of WC with TaC and/or NbC also decreases the use of critical raw materials in cemented carbide compositions, thereby providing manufacturing flexibility.

The cemented carbide compositions may contain WC as the first hard phase component in an amount that is greater than additional hard phase components (i.e., TaC and/or NbC).

The WC may generally be present in the cemented carbide composition in an amount of from 65 wt. % to 75 wt. % based on the total weight of the cemented carbide composition. In some examples, the WC is present in the cemented carbide composition in an amount of from 67 wt. % to 75 wt. % based on the total weight of the cemented carbide composition. In other examples, the WC is present in the cemented carbide composition in an amount of from 69 wt. % to 75 wt. % based on the total weight of the cemented carbide composition. In yet other examples, the WC is present in the cemented carbide composition in an amount of from 71 wt. % to 75 wt. % based on the total weight of the cemented carbide composition. In still other examples, the WC is present in the cemented carbide composition in an amount of from 73 wt. % to 75 wt. % based on the total weight of the cemented carbide composition.

In certain particular examples, the WC is present in the cemented carbide composition in an amount of from 66 wt. % to 75 wt. %, from 68 wt. % to 75 wt. %, from 70 wt. % to 75 wt. %, from 66 wt. % to 70 wt. %, from 72 wt. % to 75 wt. %, from 74 wt. % to 75 wt. %, from 67 wt. % to 74 wt. %, from 69 wt. % to 74 wt. %, from 71 wt. % to 74 wt. %, or from 73 wt. % to 74 wt. % based on the total weight of the cemented carbide composition.

WC is typically present in amounts greater than 74 wt. % based on the total weight of the cemented carbide composition for conventional WC cemented carbide compositions, but the present cemented carbide composition substitutes a portion of the WC with TaC and/or NbC. The amount of WC in the present cemented carbide composition is, therefore, less than typically used in conventional WC cemented carbide compositions.

The second hard phase component of TaC and NbC can each be utilized individually or as a mixture. TaC and/or NbC can typically be present in an amount of from 10 wt. % to 20 wt. % based on the total weight of the cemented carbide composition. In some examples, TaC and/or NbC is present in an amount of from 11 wt. % to 20 wt. % based on the total weight of the cemented carbide composition. In other examples, TaC and/or NbC is present in an amount of from 12 wt. % to 20 wt. % based on the total weight of the cemented carbide composition. In yet other examples, TaC and/or NbC is present in an amount of from 13 wt. % to 20 wt. % based on the total weight of the cemented carbide composition. In still other examples, TaC and/or NbC is present in an amount of from 14 wt. % to 20 wt. % based on the total weight of the cemented carbide composition. In further other examples, TaC and/or NbC is present in an amount of from 15 wt. % to 20 wt. % based on the total weight of the cemented carbide composition. In even other examples, TaC and/or NbC is present in an amount of from 16 wt. % to 20 wt. % based on the total weight of the cemented carbide composition. In other embodiments, TaC and/or NbC is present in an amount of from 17 wt. % to 20 wt. % based on the total weight of the cemented carbide composition. In still other embodiments, TaC and/or NbC is present in an amount of from 18 wt. % to 20 wt. % based on the total weight of the cemented carbide composition. In yet other embodiments, TaC and/or NbC is present in an amount of from 19 wt. % to 20 wt. % based on the total weight of the cemented carbide composition.

In certain particular embodiments, TaC and/or NbC is present in an amount of from 10 wt. % to 11 wt. %, from 11 wt. % to 12 wt. %, from 12 wt. % to 13 wt. %, from 10 wt. % to 13 wt. %, from 13 wt. % to 14 wt. %, from 14 wt. % to 15 wt. %, from 15 wt. % to 16 wt. %, from 13 wt. % to 16 wt. %, from 16 wt. % to 17 wt. %, from 17 wt. % to 18 wt. %, from 18 wt. % to 19 wt. %, from 16 wt. % to 19 wt. % or from 19 wt. % to 20 wt. % based on the total weight of the cemented carbide composition.

For example, the second hard phase may only be TaC in an amount of up to 20 wt. % based on the total weight of the cemented carbide composition. Alternatively, the second hard phase may only be NbC in an amount of up to 20 wt. % based on the total weight of the cemented carbide composition. Even further, the second hard phase may be a mixture of NbC and TaC in any given combination that is not inconsistent and incompatible with the subject matter disclosed herein, such that the individual amounts of NbC and TaC collectively are present in an amount of 10 wt. % to 20 wt. % based on the total weight of the cemented carbide composition.

In some examples, the second hard phase includes 9 wt. % NbC and 1 wt. % TaC based on the total weight of the cemented carbide composition, such that the amount of NbC and TaC collectively is 10 wt. % based on the total weight of the cemented carbide composition. In other examples, the second hard phase includes 9 wt. % NbC and 2 wt. % TaC based on the total weight of the cemented carbide composition, such that the amount of NbC and TaC collectively is 11 wt. % based on the total weight of the cemented carbide composition. In yet other examples, the second hard phase includes 9 wt. % NbC and 3 wt. % TaC based on the total weight of the cemented carbide composition, such that the amount of NbC and TaC collectively is 12 wt. % based on the total weight of the cemented carbide composition. In still other examples, the second hard phase includes 9 wt. % NbC and 4 wt. % TaC based on the total weight of the cemented carbide composition, such that the amount of NbC and TaC collectively is 13 wt. % based on the total weight of the cemented carbide composition. In further other examples, the second hard phase includes 9 wt. % NbC and 5 wt. % TaC based on the total weight of the cemented carbide composition, such that the amount of NbC and TaC collectively is 14 wt. % based on the total weight of the cemented carbide composition. In even other examples, the second hard phase includes 9 wt. % NbC and 6 wt. % TaC based on the total weight of the cemented carbide composition, such that the amount of NbC and TaC collectively is 15 wt. % relative to the total weight of the cemented carbide composition. In other embodiments, the second hard phase includes 9 wt. % NbC and 7 wt. % TaC based on the total weight of the cemented carbide composition, such that the amount of NbC and TaC collectively is 16 wt. % based on the total weight of the cemented carbide composition. In yet other embodiments, the second hard phase includes 9 wt. % NbC and 8 wt. % TaC based on the total weight of the cemented carbide composition, such that the amount of NbC and TaC collectively is 17 wt. % based on the total weight of the cemented carbide composition. In still other embodiments, the second hard phase includes 9 wt. % NbC and 9 wt. % TaC based on the total weight of the cemented carbide composition, such that the amount of NbC and TaC collectively is 18 wt. % based on the total weight of the cemented carbide composition. In further other embodiments, the second hard phase includes 9 wt. % NbC and 10 wt. % TaC based on the total weight of the cemented carbide composition, such that the amount of NbC and TaC collectively is 19 wt. % based on the total weight of the cemented carbide composition. In yet other embodiments, the second hard phase includes 9 wt. % NbC and 11 wt. % TaC based on the total weight of the cemented carbide composition, such that the amount of NbC and TaC collectively is 20 wt. % based on the total weight of the cemented carbide composition.

In some embodiments, the second hard phase includes 1 wt. % NbC and 9 wt. % TaC based on the total weight of the cemented carbide composition, such that the amount of NbC and TaC collectively is 10 wt. % based on the total weight of the cemented carbide composition. In other embodiments, the second hard phase includes 2 wt. % NbC and 9 wt. % TaC based on the total weight of the cemented carbide composition, such that the amount of NbC and TaC collectively is 11 wt. % based on the total weight of the cemented carbide composition. In yet other embodiments, the second hard phase includes 3 wt. % NbC and 9 wt. % TaC based on the total weight of the cemented carbide composition, such that the amount of NbC and TaC collectively is 12 wt. % based on the total weight of the cemented carbide composition. In still other embodiments, the second hard phase includes 4 wt. % NbC and 9 wt. % TaC based on the total weight of the cemented carbide composition, such that the amount of NbC and TaC collectively is 13 wt. % based on the total weight of the cemented carbide composition. In further other embodiments, the second hard phase includes 5 wt. % NbC and 9 wt. % TaC based on the total weight of the cemented carbide composition, such that the amount of NbC and TaC collectively is 14 wt. % based on the total weight of the cemented carbide composition. In even other embodiments, the second hard phase includes 6 wt. % NbC and 9 wt. % TaC based on the total weight of the cemented carbide composition, such that the amount of NbC and TaC collectively is 15 wt. % based on the total weight of the cemented carbide composition. In other examples, the second hard phase includes 7 wt. % NbC and 9 wt. % TaC based on the total weight of the cemented carbide composition, such that the amount of NbC and TaC collectively is 16 wt. % based on the total weight of the cemented carbide composition. In yet other examples, the second hard phase includes 8 wt. % NbC and 9 wt. % TaC based on the total weight of the cemented carbide composition, such that the amount of NbC and TaC collectively is 17 wt. % based on the total weight of the cemented carbide composition. In still other examples, the second hard phase includes 9 wt. % NbC and 9 wt. % TaC based on the total weight of the cemented carbide composition, such that the amount of NbC and TaC collectively is 18 wt. % based on the total weight of the cemented carbide composition. In further other examples, the second hard phase includes 10 wt. % NbC and 9 wt. % TaC based on the total weight of the cemented carbide composition, such that the amount of NbC and TaC collectively is 19 wt. % based on the total weight of the cemented carbide composition. In even other examples, the second hard phase includes 11 wt. % NbC and 9 wt. % TaC based on the total weight of the cemented carbide composition, such that the amount of NbC and TaC collectively is 20 wt. % based on the total weight of the cemented carbide composition.

In addition to the specifically referenced components above, the hard phase can additionally include additional hard phase components, such as carbides, carbonitrides, and/or nitrides of Ti, Nb, V, Ta, Cr, Zr, and Hf, and mixtures thereof.

The cemented carbide composition can also contain a binder phase including at least one binder selected from the group consisting of Co, Ni, and mixtures thereof. In certain embodiments, the binder is Co, such that the cemented carbide composition is composed of WC—Co. In other embodiments, the binder is Co—Ni, such that the cemented carbide composition is composed of WC—Co—Ni.

The binder may typically be present in the cemented carbide composition in an amount of from 8.00 wt. % to 12.00 wt. % based on the total weight of the cemented carbide composition. In some examples, the binder is present in the cemented carbide composition in an amount of from 8.25 wt. % to 12.00 wt. % based on the total weight of the cemented carbide composition. In other examples, the binder is present in the cemented carbide composition in an amount of from 8.50 wt. % to 12.00 wt. % based on the total weight of the cemented carbide composition. In yet other examples, the binder is present in the cemented carbide composition in an amount of from 8.75 wt. % to 12.00 wt. % based on the total weight of the cemented carbide composition. In still other examples, the binder is present in the cemented carbide composition in an amount of from 9.00 wt. % to 12.00 wt. % based on the total weight of the cemented carbide composition. In even other examples, the binder is present in the cemented carbide composition in an amount of from 9.25 wt. % to 12.00 wt. % based on the total weight of the cemented carbide composition. In further other examples, the binder is present in the cemented carbide composition in an amount of from 9.50 wt. % to 12.00 wt. % based on the total weight of the cemented carbide composition. In other embodiments, the binder is present in the cemented carbide composition in an amount of from 9.75 wt. % to 12.00 wt. % based on the total weight of the cemented carbide composition. In even other embodiments, the binder is present in the cemented carbide composition in an amount of from 10.00 wt. % to 12.00 wt. % based on the total weight of the cemented carbide composition.

In certain particular embodiments, the binder is present in an amount of from 8.00 wt. % to 8.50 wt. %, from 8.50 wt. % to 9.25 wt. %, from 9.25 wt. % to 9.75 wt. %, from 8.00 wt. % to 9.75 wt. %, from 9.75 wt. % to 10.25 wt. %, from 10.25 wt. % to 10.75 wt. %, from 10.75 wt. % to 11.25 wt. %, from 9.75 wt. % to 11.25 wt. %, or from 11.25 wt. % to 12.00 wt. % based on the total weight of the cemented carbide composition.

The cemented carbide composition can also contain a grain growth inhibitor, such as for example $Mo_2C$ generally in a range of from approximately 0.5 wt. % to approximately 1.5 wt. % based on the total weight of the cemented carbide composition. In some examples, the grain growth inhibitor is present in an amount of from approximately 0.6 wt. % to approximately 1.5 wt. % based on the total weight of the cemented carbide composition. In other examples, the grain growth inhibitor is present in an amount of from approximately 0.7 wt. % to approximately 1.5 wt. % based on the total weight of the cemented carbide composition. In still other examples, the grain growth inhibitor is present in an amount of from approximately 0.8 wt. % to approximately 1.5 wt. % based on the total weight of the cemented carbide composition. In yet other examples, the grain growth inhibitor is present in an amount of from approximately 0.9 wt. % to approximately 1.5 wt. % based on the total weight of the cemented carbide composition. In even other examples, the grain growth inhibitor is present in an amount of from approximately 1 wt. % to approximately 1.5 wt. % based on the total weight of the cemented carbide composition. In further other examples, the grain growth inhibitor is present in an amount of from approximately 1.1 wt. % to approximately 1.5 wt. % based on the total weight of the cemented carbide composition. In other embodiments, the grain growth inhibitor is present in an amount of from approximately 1.2 wt. % to approximately 1.5 wt. % based on the total weight of the cemented carbide composition. In yet other embodiments, the grain growth inhibitor is present in an amount of from approximately 1.3 wt. % to approximately 1.5 wt. % based on the total weight of the cemented carbide composition. In still other embodiments, the grain growth inhibitor is present in an amount of from approximately 1.4 wt. % to 1.5 wt. % based on the total weight of the cemented carbide composition.

In certain particular embodiments, the grain growth inhibitor is present in an amount of approximately from 0.5 wt. % to approximately 0.6 wt. %, from approximately 0.6 wt. % to approximately 0.7 wt. %, from approximately 0.7 wt. % to approximately 0.8 wt. %, from approximately 0.5 wt. % to approximately 0.8 wt. %, from approximately 0.8 wt. % to approximately 0.9 wt. %, from approximately 0.9 wt. % to approximately 1.0 wt. %, from approximately 1.0 wt. % to approximately 1.1 wt. %, from approximately 0.8 wt. % to approximately 1.1 wt. %, from approximately 1.1 wt. % to approximately 1.2 wt. %, from approximately 1.2 wt. % to approximately 1.3 wt. %, from approximately 1.3 wt. % to approximately 1.4 wt. %, from approximately 1.1 wt. % to approximately 1.4 wt. %, or from approximately 1.4 wt. % to approximately 1.5 wt. % based on the total weight of the cemented carbide composition.

The cemented carbide compositions of the present application may have an HV30 Vicker's hardness of from 1450 to 1600. In certain embodiments, the cemented carbide compositions have an HV30 Vicker's hardness in the range of from 1450 to 1500. In certain particular embodiments, the cemented carbide compositions have an HV30 Vicker's hardness in the range of from 1500 to 1550, or from 1525 to 1550. The hardness is the HV30 Vickers hardness with a test load of 30 kgf measured according to the ISO 28079-2009 standard.

The cemented carbide compositions of the present application can have a Palmqvist fracture toughness, $K_{Ic}$, of from 8.5 MPa√m to 10 MPa√m. In certain embodiments, the cemented carbide compositions have a Palmqvist fracture toughness, $K_{Ic}$, of from 9 MPa√m to 9.5 MPa√m. In certain particular embodiments, the cemented carbide compositions have a Palmqvist fracture toughness, $K_{Ic}$, of from 9.1 MPa√m to 10 MPa√m. The toughness is the fracture toughness measured according to the ISO 28079-2009 standard.

The following TABLE 1 shows certain embodiments of the cemented carbide compositions of the present application, including obtained HV30 Vicker's hardness and Palmqvist fracture toughness measurements.

TABLE 1

| Grade | WC (wt. %) | Co (wt. %) | Ni (wt. %) | NbC (wt. %) | TaC (wt. %) | $Mo_2C$ (wt. %) | Total (wt. %) | HV30 | $K_{Ic}$ (MPa√m) |
|---|---|---|---|---|---|---|---|---|---|
| B79 | 69 | 10 | 0 | 20 | 0 | 1 | 100 | 1559 | 8.9 |
| B103 | 74 | 9 | 1 | 15 | 0 | 1 | 100 | 1500 | 9.5 |
| B80 | 70 | 10 | 0 | 0 | 20 | 0 | 100 | 1470 | 9.1 |

FIGS. 1-6 show scanning electron microscope (SEM) images of the embodiments of the exemplary cemented carbide compositions of Table 1 at a 2000× and a 5000× magnification respectively. As seen in FIGS. 1-6, the obtained cemented carbide compositions demonstrate homogeneous microstructures.

In addition to the cemented carbide compositions discussed above, according to a second embodiment, the present application also includes a cemented carbide composition having a hard phase including WC as a hard phase component, NbC as an anti-galling phase, and TaC as a toughness improver, and a binder phase including at least one binder component selected from the group consisting of Co, Ni, and mixtures thereof. That is, each of the WC, NbC, and TaC are included in the cemented carbide of the present embodiment. The present embodiment achieves excellent anti-galling properties when used in cutting inserts against for example stainless steel, titanium, and non-ferrous alloys. The cemented carbide composition of the present embodiment also displays improved anti-galling properties, low coefficient of friction (COF), and good hardness/toughness ratio when compared to WC—Co.

The cemented carbide composition can also contain a grain growth inhibitor. Examples of acceptable grain growth inhibitors include, but are not limited to, Mo, MoC, $Mo_2C$, $Cr_3C_2$, and mixtures thereof. In particular, the composition may or may not have $Cr_3C_2$, since $Cr_3C_2$ may generate embrittlement together with the NbC anti-galling phase, and thus $Cr_3C_2$ is optionally included in the cemented carbide. When $Cr_3C_2$ is included in the cemented carbide composition, the $Cr_3C_2$ may be typically present in an amount of from approximately 0.1 wt. % to approximately 1.5 based on the total weight of the cemented carbide composition. In some examples, the grain growth inhibitor is present in an amount of from approximately 0.3 wt. % to approximately 1.5 wt. % based on the total weight of the cemented carbide composition. In other examples, the grain growth inhibitor is present in an amount of from approximately 0.5 wt. % to approximately 1.5 wt. % based on the total weight of the cemented carbide composition. In still other examples, the grain growth inhibitor is present in an amount of from approximately 0.7 wt. % to approximately 1.5 wt. % based on the total weight of the cemented carbide composition. In yet other examples, the grain growth inhibitor is present in an amount of from approximately 0.9 wt. % to approximately 1.5 wt. % based on the total weight of the cemented carbide composition. In even other examples, the grain growth inhibitor is present in an amount of from approximately 1.1 wt. % to approximately 1.5 wt. % based on the total weight of the cemented carbide composition. In further other examples, the grain growth inhibitor is present in an amount of from approximately 1.3 wt. % to approximately 1.5 wt. % based on the total weight of the cemented carbide composition.

In certain particular embodiments, the grain growth inhibitor is present in an amount of approximately from 0.1 wt. % to approximately 0.3 wt. %, from approximately 0.3 wt. % to approximately 0.5 wt. %, from approximately 0.5 wt. % to approximately 0.7 wt. %, from approximately 0.1 wt. % to approximately 0.7 wt. %, from approximately 0.7 wt. % to approximately 0.9 wt. %, from approximately 0.9 wt. % to approximately 1.1 wt. %, from approximately 1.1 wt. % to approximately 1.3 wt. %, from approximately 0.7 wt. % to approximately 1.3 wt. %, or from approximately 1.3 wt. % to approximately 1.4 wt. % based on the total weight of the cemented carbide composition.

The grain growth inhibitor may also be from 0.50 wt. % to 3.00 wt. % of at least one component selected from the group consisting of Mo, MoC, $Mo_2C$, a mixture thereof based on the total weight of the cemented carbide composition. In some examples, the grain growth inhibitor is present in an amount of from 0.75 wt. % to 3.00 wt. % of at least one component selected from the group consisting of Mo, MoC, $Mo_2C$, a mixture thereof based on the total weight of the cemented carbide composition. In other examples, the grain growth inhibitor is present in an amount of from 1.00 wt. % to 3.00 wt. % of at least one component selected from the group consisting of Mo, MoC, $Mo_2C$, a mixture thereof based on the total weight of the cemented carbide composition. In yet other examples, the grain growth inhibitor is present in an amount of from 1.25 wt. % to 3.00 wt. % of at least one component selected from the group consisting of Mo, MoC, $Mo_2C$, a mixture thereof based on the total weight of the cemented carbide composition. In still other examples, the grain growth inhibitor is present in an amount of from 1.50 wt. % to 3.00 wt. % of at least one component selected from the group consisting of Mo, MoC, $Mo_2C$, a mixture thereof based on the total weight of the cemented carbide composition. In further other examples, the grain growth inhibitor is present in an amount of from 1.75 wt. % to 3.00 wt. % of at least one component selected from the group consisting of Mo, MoC, $Mo_2C$, a mixture thereof based on the total weight of the cemented carbide composition. In even other examples, the grain growth inhibitor is present in an amount of from 2.00 wt. % to 3.00 wt. % of at least one component selected from the group consisting of Mo, MoC, $Mo_2C$, a mixture thereof based on the total weight of the cemented carbide composition. In other embodiments, the grain growth inhibitor is present in an amount of from 2.25 wt. % to 3.00 wt. % of at least one component selected from the group consisting of Mo, MoC, $Mo_2C$, a mixture thereof based on the total weight of the cemented carbide composition. In still other embodiments, the grain growth inhibitor is present in an amount of from 2.50 wt. % to 3.00 wt. % of at least one component selected from the group consisting of Mo, MoC, $Mo_2C$, a mixture thereof based on the total weight of the cemented carbide composition. In still other embodiments, the grain growth inhibitor is present in an amount of from 2.75 wt. % to 3.00 wt. % of at least one component selected from the group consisting of Mo, MoC, $Mo_2C$, a mixture thereof based on the total weight of the cemented carbide composition.

In some particular embodiments, the grain growth inhibitor is present in an amount of from 0.50 wt. % to 0.75 wt. %, from 0.75 wt. % to 1.00 wt. %, from 1.00 wt. % to 1.25 wt. %, from 0.50 wt. % to 1.25 wt. %, from 1.25 wt. % to 1.50 wt. %, from 1.50 wt. % to 1.75 wt. %, from 1.75 wt. % to 2.00 wt. %, from 1.25 wt. % to 2.00 wt. %, from 2.00 wt. % to 2.25 wt. %, from 2.25 wt. % to 2.50 wt. %, from 2.50 wt. % to 2.75 wt. %, or from 2.00 wt. % to 2.75 wt. %, of at least one component selected from the group consisting of Mo, MoC, $Mo_2C$, a mixture thereof based on the total weight of the cemented carbide composition.

The cemented carbide composition may contain WC as a hard phase. The cemented carbide composition has WC as a balance relative to the other components of the cemented carbide composition. The cemented carbide composition may also contain NbC as an anti-galling phase. The cemented carbide composition may typically include from 15 wt. % to 30 wt. % of the NbC as the anti-galling phase based on the total weight of the cemented carbide composition. In some examples, the cemented carbide composition includes from 17 wt. % to 30 wt. % of the NbC as the anti-galling phase based on the total weight of the cemented carbide composition. In other examples, the cemented carbide composition includes from 19 wt. % to 30 wt. % of the NbC as the anti-galling phase based on the total weight of the cemented carbide composition. In yet other examples, the cemented carbide composition includes from 21 wt. % to 30 wt. % of the NbC as the anti-galling phase based on the total weight of the cemented carbide composition. In still other examples, the cemented carbide composition includes from 23 wt. % to 30 wt. % of the NbC as the anti-galling phase based on the total weight of the cemented carbide composition. In further other examples, the cemented carbide composition includes from 25 wt. % to 30 wt. % of the NbC as the anti-galling phase based on the total weight of the cemented carbide composition. In even other examples, the cemented carbide composition includes from 27 wt. % to 30 wt. % of the NbC as the anti-galling phase based on the total weight of the cemented carbide composition.

In certain particular embodiments, the cemented carbide composition includes from 15 wt. % to 17 wt. %, from 17 wt. % to 19 wt. %, from 19 wt. % to 21 wt. %, from 15 wt. % to 19 wt. %, from 15 wt. % to 21 wt. %, from 21 wt. % to 23 wt. %, from 23 wt. % to 25 wt. %, from 25 wt. % to 27 wt. %, from 21 wt. % to 25 wt. %, from 21 wt. % to 27 wt. %, from 27 wt. % to 29 wt. %, or from 29 wt. % to 30 wt. % of the NbC as the anti-galling phase based on the total weight of the cemented carbide composition.

The cemented carbide composition may also include TaC as a toughness improver. The cemented carbide composition may include from approximately 0.3 wt. % to 9.0 wt. % of the TaC as the toughness improver based on the total weight of the cemented carbide composition. In some embodiments, the cemented carbide composition includes from approximately 1.3 wt. % to 9.0 wt. % of the TaC as the toughness improver based on the total weight of the cemented carbide composition. In other embodiments, the cemented carbide composition includes from approximately 2.3 wt. % to 9.0 wt. % of the TaC as the toughness improver based on the total weight of the cemented carbide composition. In yet other embodiments, the cemented carbide composition includes from approximately 3.3 wt. % to 9.0 wt. % of the TaC as the toughness improver based on the total weight of the cemented carbide composition. In still other embodiments, the cemented carbide composition includes from approximately 4.3 wt. % to 9.0 wt. % of the TaC as the toughness improver based on the total weight of the cemented carbide composition. In even other embodiments, the cemented carbide composition includes from approximately 5.3 wt. % to 9.0 wt. % of the TaC as the toughness improver based on the total weight of the cemented carbide composition. In some examples, the cemented carbide composition includes from approximately 6.3 wt. % to 9.0 wt. % of the TaC as the toughness improver based on the total weight of the cemented carbide composition. In other examples, the cemented carbide composition includes from approximately 7.3 wt. % to 9.0 wt. % of the TaC as the toughness improver based on the total weight of the cemented carbide composition. In yet other examples, the cemented carbide composition includes from approximately 8.3 wt. % to 9.0 wt. % of the TaC as the toughness improver based on the total weight of the cemented carbide composition.

In certain particular embodiments, cemented carbide composition includes from approximately 0.3 wt. % to 1.3 wt. %, from approximately 1.3 wt. % to approximately 2.3 wt. %, from approximately 2.3 wt. % to approximately 3.3 wt. %, from approximately 0.3 wt. % to approximately 3.3 wt. %, from approximately 3.3 wt. % to approximately 4.3 wt. %, from approximately 4.3 wt. % to approximately 5.3 wt. %, from approximately 5.3 wt. % to approximately 6.3 wt. %, from approximately 3.3 wt. % to approximately 6.3 wt. %, from approximately 6.3 wt. % to approximately 7.3 wt. %, from approximately 2 wt. % to approximately 5 wt. %, from approximately 2 wt. % to approximately 8 wt. %, or from approximately 7.3 wt. % to approximately 8.3 wt. % of the TaC as the toughness improver based on the total weight of the cemented carbide composition.

The cemented carbide composition may further contain a binder phase including at least one binder selected from the group consisting of Co, Ni, and mixtures thereof. In certain embodiments, the binder is Co or Co—Ni binder. The presence of Ni may be desired to dissolve and reconvert NbC into the microstructure. The cemented carbide composition may generally include from 5 wt. % to 15 wt. % of the binder based on the total weight of the cemented carbide composition. In some examples, the carbide composition includes from 7 wt. % to 15 wt. % of the binder based on the total weight of the cemented carbide composition. In other examples, the carbide composition includes from 9 wt. % to 15 wt. % of the binder based on the total weight of the cemented carbide composition. In still other examples, the carbide composition includes from 11 wt. % to 15 wt. % of the binder based on the total weight of the cemented carbide composition. In yet other examples, the carbide composition includes from 13 wt. % to 15 wt. % of the binder based on the total weight of the cemented carbide composition.

In certain particular embodiments, the carbide composition includes from 5 wt. % to 7 wt. %, from 5 wt. % to 9 wt. %, from 5 wt. % to 10 wt. %, from 7 wt. % to 9 wt. %, from 9 wt. % to 11 wt. %, from 7 wt. % to 10 wt. %, from 7 wt. % to 11 wt. %, from 11 wt. % to 13 wt. %, or from 13 wt. % to 14 wt. % of the binder based on the total weight of the cemented carbide composition.

Tools

Each of the above discussed cemented carbide compositions described in accordance with the first and second embodiments can be used in a variety of applications. For instance, the above discussed cemented carbide compositions can be used as tool inserts. Such tool inserts generally utilize the excellent properties of the disclosed cemented carbide compositions to reduce wear and improve cutting, drilling, milling, grinding performance of the tool.

Method of Fabrication

The present application also includes a method of making the cemented carbide compositions discussed above. The method includes providing a batch of powdered raw materials according to the above disclosures, pressing the batch of powdered raw materials to form a pre-compact, and sintering the pre-compact. For example, the batch of powdered raw materials can include the embodiments of the cemented carbide compositions shown in Table 1 hereinbefore. In another embodiment, the batch of powdered raw materials can include the raw materials for producing the cemented carbide includes a hard phase including WC as a hard phase component, NbC as an anti-galling phase, and TaC as a toughness improver, and a binder phase including at least one binder component selected from the group consisting of Co, Ni, and mixtures thereof. The WC, NbC, TaC, and binder can be mixed with additional ingredients, such as a grain growth inhibitor, to produce the batch of powdered raw materials.

The used WC, NbC and TaC may generally have an average particle size ranging for example from 0.5 μm to 30 μm. In some examples, WC, NbC and TaC have an average particle size in the range from 1 μm to 5 μm. In other examples, WC, NbC and TaC have an average particle size in the range from 1 μm to 10 μm. In still other examples, WC, NbC and TaC have an average particle size in the range from 1 μm to 15 μm. In yet other examples, WC, NbC and TaC have an average particle size in the range from 1 μm to 20 μm. In further examples, WC, NbC and TaC have an average particle size in the range from 1 μm to 25 μm. In further other examples, WC, NbC and TaC have an average particle size in the range from 1 μm to 30 μm. In certain particular embodiments, WC, NbC and TaC have an average particle size in the range from 5 μm to 10 μm, from 10 μm to 15 μm, from 5 μm to 15 μm, from 15 μm to 20 μm, from 5 μm to 20 μm, from 20 μm to 25 μm, from 5 μm to 25 μm, from 25 μm to 30 μm, or from 5 μm to 30 μm.

For determining a characteristic size range within which particle size, one having ordinary skill in the art may typically employ either dynamic digital image analysis (DIA), static laser light scattering (SLS) also known as laser diffraction, or by visual measurement by electron microscopy, a technique known as image analysis and light obscuration. Each method covers a measurement is possible. These ranges partly overlap. However, the results for measuring the same sample may vary all depending on the particular method that is used. A skilled artisan who wants to determine particle sizes or particle size distributions would readily know how each mentioned method is commonly performed and practiced. Thus, the reader is directed to for example, (i) "Comparison of Methods. Dynamic Digital Image Analysis, Laser Diffraction, Sieve Analysis", Retsch Technology and (ii) the scientific publication by Kelly et al., "Graphical comparison of image analysis and laser diffraction particle size analysis data obtained from the measurements of nonspherical particle systems", AAPS PharmSciTech. 2006 Aug. 18; Vol. 7(3):69, to further gain insight into each procedure and methodology, all of which documents, are incorporated herein by reference in their entirety.

A desired particle size of the cemented carbide and the cermet powders can be produced by subjecting the cemented carbide and cermet powders to a milling operation for several hours (e.g. 8, 16, 32, 64 hours) under ambient conditions (i.e. 25° C., 298.15 K and a pressure of 101.325 kPa in a ball mill or an attritor mill) with metallic binder(s) in the production of the powders. As would be apparent to a skilled artisan, the milling is made by first adding a milling liquid to the powder to form a milling powder slurry composition. The milling liquid may be water, an alcohol such as but not limited to ethanol, methanol, isopropanol, butanol, cyclohexanol, an organic solvent in the likes of for example acetone or toluene, an alcohol mixture, an alcohol and a solvent mixture or like constituents. The properties of the milling powder slurry composition are dependent on, among other things, the amount of the milling liquid that is added. Because the drying of the milling powder slurry composition requires energy, the amount of the used milling liquid should preferably be minimized to keep costs down. However, enough milling liquid needs to be added to achieve a pumpable milling powder slurry composition and to avoid clogging of the system. Moreover, other compounds commonly known in the art to a skilled artisan can be added to the slurry e.g. dispersion agents, pH-adjusters, etc. An organic binder(s), such as e.g. polyethylene glycol (PEG), paraffin, polyvinyl alcohol (PVA), long chain fatty acids, wax, or any combination thereof or like components may be added to the milling powder slurry composition prior to the milling typically from for example 15 vol % to 25 vol % of the total volume of the formed slurry, to facilitate the formation of agglomerates, and additionally to act as a pressing agent in the subsequent following pressing steps.

The milled powder slurry composition can be spray-dried, freeze-dried or vacuum-dried and granulated to provide free-flowing powder aggregates of various shape including for example a spherical shape. Alternatively, the milled powder slurry composition can be vacuum-dried, to provide powder suitable for isostatic compaction when forming green bodies. In some instances, the cemented carbide powders can be crushed or otherwise comminuted prior to milling with the metallic binder(s).

In the case of spray drying, the slurry containing the powdered materials mixed with the organic liquid, and possibly, the organic binder(s) may be atomized through an appropriate nozzle in the drying tower, where the small drops are instantaneously dried by a stream of hot gas, for instance in a stream of nitrogen, to form spherical powder agglomerates with good and acceptable flow properties.

The powders are formed or consolidated into a green article or body in the preparation for the sintering procedure. A green body is formed of the powder blend using conventional techniques such as cold tool pressing technology including multi axial pressing (MAP), extruding or metal injection molding (MIM), cold isostatic pressing, pill pressing, tape casting and other methods known in the powder metallurgy art. Any consolidation method can be utilized that is not inconsistent and incompatible with the objectives of the present subject matter. Forming yields a green density and/or strength that permits easy handling and green machining. In one example of the present disclosure, the forming is done by a pressing operation. Here, the pressing may be conducted by a uniaxial pressing operation at a force commonly used from 5 ton to 40 ton.

Additional manufacturing techniques contemplated herein may include, but are not limited to for example, binder jetting, material jetting, laser powder bed, electron beam powder bed or directed energy deposition as described in ASTM (American Society for Testing and Materials) Committee F-42 on Additive Manufacturing Technologies. The green body can take the form of a blank, or can otherwise assume, a near-net shape forth of the desired cutting element, including cutting insert, drill or endmill. In some examples, the green body is mechanically worked to provide the desired shape.

The green bodies may be subjected to a pre-sintering temperature elevation procedure, to successfully remove the organic binder(s). This may be done in the same apparatus when executing the sintering consolidation process further described hereinbelow. Suitable temperatures for the removal of the organic binder(s) may be employed from 200° C. to 450° C., from 200° C. to 500° C., from 200° C. to 600° C., from 250° C. to 450° C., from 250° C. to 500° C., from 250° C. to 600° C., from 300° C. to 450° C., from 300° C. to 500° C., or from 300° C. to 600° C. under typically a reactive $H_2$ atmosphere generally with a $H_2$ flow rate from 1000 L/Hour to 10000 L/Hour by customarily increasing the temperature at a rate of for example approximately 0.70° C./min. In some examples, after the organic binder(s) removal, the temperature is increased at a rate of about 2° C./min. to about 10° C./min., or at a rate of about 2° C./min. to about 5° C./min. up to a desired pre-sintering temperature. The temperature may be maintained for 1 minute to 90 minutes until the entire change of bodies in the sintering furnace has reached the desired temperature and the desired phase-transformation has been completed. In general, the pre-sintering step may be conducted in vacuum, or in a reactive ($H_2$), or a non-reactive atmosphere e.g. nitrogen ($N_2$), argon (Ar) or a carbon-containing gas.

The pre-sintered and debinded green bodies subsequently undergo a sintering consolidation process to ultimately form the sintered end-material. This may usually be performed typically using a pressure from 50 bar to 75 bar, from 50 bar to 80 bar, from 50 bar to 85 bar, from 50 bar to 90 bar, from 60 bar to 75 bar, from 60 bar to 80 bar, from 60 bar to 85 bar, from 60 bar to 90 bar, from 70 bar to 75 bar, from 70 bar to 80 bar, from 70 bar to 85 bar, or from 70 bar to 90 bar. Depending however on the composition, this pressure range might be lowered to a range from 35 bar to 60 bar at a temperature range from 1300° C. to 1500° C., from 1300° C. to 1600° C., from 1300° C. to 1700° C., from 1300° C. to 1800° C., from 1400° C. to 1500° C., from 1400° C. to 1600° C., from 1400° C. to 1700° C., from 1400° C. to 1800° C., from 1500° C. to 1600° C., from 1500° C. to 1700° C., or from 1500° C. to 1800° C., with a dwell time employed at a maximum temperature, which is typically from 1 minute and 60 minutes.

A skilled artisan would in practice readily know how a sintering consolidation procedure is commonly performed and practiced. Thus, the reader is directed to for example U.S. Pat. Nos. 10,232,493B2, 10,337,256B2 10,753,158B2, US Application Publication 2018/0245406 A1, US Application Publication 2018/0009716 A1 to further gain insight into sintering procedures and methodologies, all of which documents, are incorporated herein by reference in their entirety. Each provides examples of sintering procedures and methodologies.

The green bodies can suitably be either subjected to vacuum sintering or sintering under an argon (Ar) or hydrogen/methane atmosphere. During vacuum sintering, the green body is placed in a vacuum furnace and sintered at temperatures of generally from 1300° C. to 1500° C., from 1300° C. to 1600° C., from 1300° C. to 1700° C., from 1300° C. to 1800° C., from 1400° C. to 1500° C., from 1400° C. to 1600° C., from 1400° C. to 1700° C., from 1400° C. to 1800° C., from 1500° C. to 1600° C., from 1500° C. to 1700° C., or from 1500° C. to 1800° C. In some examples, hot isostatic pressing (HIP) may be added to the vacuum sintering process. Hot isostatic pressing can be administered as a post-sintering operation or during vacuum sintering thereby yielding a sinter-HIP process. The resulting sintered cemented carbide can exhibit hardness and fracture toughness as described herein this disclosure.

Figure 7:
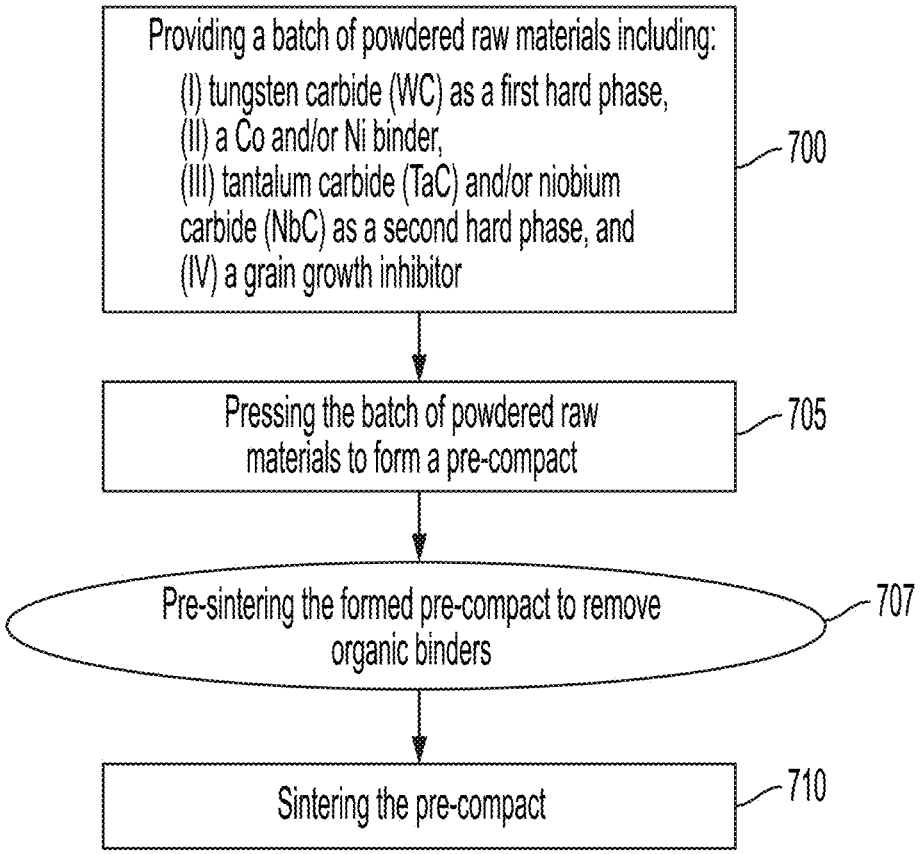
FIG. 7 is a flow diagram showing the individual process steps of producing a cemented carbide in accordance with an embodiment of the subject matter.

FIG. 7 depicts a flow diagram showing the individual process steps of fabricating a cemented carbide in accordance with an embodiment of the subject matter. FIG. 7 demonstrates that in step 700, the process is initiated by providing a batch of powdered raw materials including (I) tungsten carbide (WC) as a first hard phase component, (II) a binder including at least one component selected from the group consisting of cobalt (Co), nickel (Ni), and mixtures thereof, (III) at least one component selected from the group consisting of tantalum carbide (TaC), niobium carbide (NbC), and mixtures thereof as a second hard phase component, and (IV) a grain growth inhibitor. In step 705, the batch of powdered raw materials is pressed in order to form a pre-compact. In step 707, a pre-sintering temperature elevation procedure is undertaken to remove any potentially remaining organic binders in the formed pre-compact. The process is ultimately concluded in step 710 by sintering the formed pre-compact to finally obtain the sintered cemented carbide.

EXAMPLES

The following examples are put forth so as to provide those of ordinary skill in the art with a complete disclosure and description of how to make and use the described subject matter and are not intended to limit the scope of what the inventors regard as their disclosure nor are they intended to represent that the experiments below are all or the only experiments performed. Efforts have been made to ensure accuracy with respect to numbers used but some experimental errors and deviations should be accounted for. Unless indicated otherwise, parts are by weight, temperature is in degrees Centigrade, and pressure is at or near atmospheric.

Example 1

Cemented Carbide Compositions With Niobium Carbide Demonstrate Improved Anti-Galling Properties The cemented carbide compositions B79 and B103 shown in TABLE 1 were tested for their anti-galling properties in comparison to reference compositions that did not have NbC therein. Hence, each of B79 and B103 was compared to its respective reference composition. Thus, instead of NbC, which was excluded from their respective reference compositions, they had instead additional added amount of WC, ultimately making up the following reference compositions: (I) 89.5 wt. % WC, 10 wt. % Co, 0.5 wt. % $Cr_3C_2$ and (II) 89.5 wt. % WC, 9 wt. % Co, 1 wt. % Ni, 0.5 wt. % $Cr_3C_2$. The coefficient of friction (COF) and galling events were determined for the cemented carbide compositions B79 and B103 depicted in TABLE 1, as well as for the aforementioned formed reference compositions. The galling resistance is not merely a function of the coefficient of friction (COF), but also considers the presence of galling events. Obtained results demonstrated a favorably lower coefficient of friction (COF) and a decrease in galling events (i.e. improvement in galling resistance) for the cemented carbide compositions B79 and B103 displayed in TABLE 1 compared to the reference compositions, which were devoid of NbC. Thus, it is clear that the cemented carbide compositions B79 and B103 depicted in TABLE 1 having NbC therein advantageously display improved anti-galling properties as opposed to reference compositions lacking NbC as an anti-galling component.

Example 2

Figure 8:
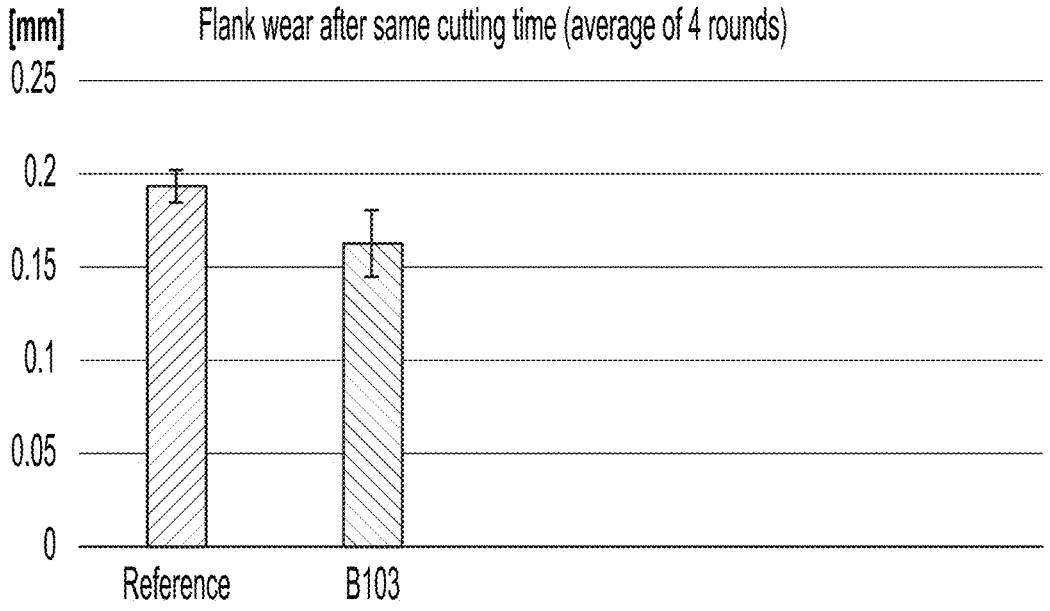
FIG. 8 shows results of the average flank wear in millimeters (mm) from four replicas in a turning test conducted on a 316L stainless steel slab of a cemented carbide composition in accordance with an embodiment of the subject matter.

Cemented Carbide Compositions With Niobium Carbide Demonstrate Improved Resistance to Flank Wear CNGA432 inserts were produced with the composition B103 shown in TABLE 1. Turning tests were conducted on a 316L stainless steel slab with a cutting speed characterized by 122 m/min, a depth of cut of 0.25 mm, a feed rate of 0.2 mm/rev and an axial length of the cut of 41.25 mm. Flank wear was measured as a function of the time of the cut for the composition B103 and compared to the reference from Example 1 made up by the composition 89.5 wt. % WC, 10 wt. % Co, 0.5 wt. % $Cr_3C_2$. Four test replicas were run and the flank wear in mm was determined as an average of the four test replicas. The determined average of the flank wear from the four tests is shown in FIG. 8. Composition B103 depicted in TABLE 1 demonstrated an average flank wear of 0.163 mm, whereas the reference displayed a flank wear of 0.194 mm. Thus, an improved resistance to flank wear of approximately 16% was achieved for composition B103 composed with NbC in comparison to the reference material. Consequently, it is clear from the obtained results depicted in FIG. 8 that the composition B103 having NbC therein favorably exhibits improved resistance to flank wear, due to a lower, hence an improved coefficient of friction (COF).

Figure 9A:
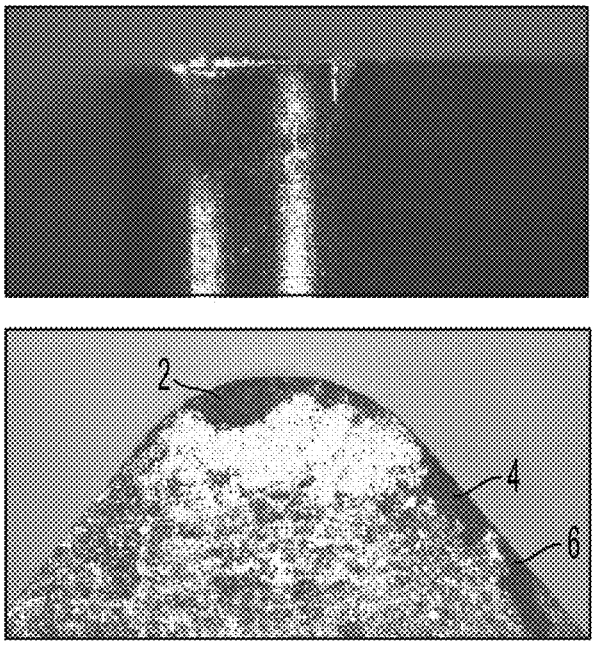
FIG. 9A shows photographs of a reference material after conducting a turning test on a 316L stainless steel slab in accordance with an embodiment of the subject matter.
Figure 9B:
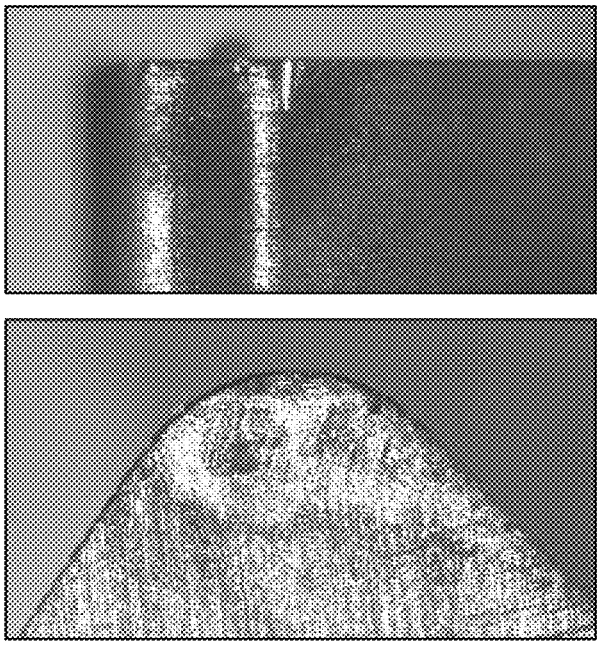
FIG. 9B shows photographs of a cemented carbide composition of the present application after conducting a turning test on a 316L stainless steel slab in accordance with an embodiment of the subject matter.

FIG. 9A shows photographs of the reference material, while FIG. 9B shows photographs of the composition B103 displayed in TABLE 1 after conducting the turning test on the 316L stainless steel slab. The structural damage that has occurred in the reference material due to the flank wear seen in FIG. 9A is obvious and best demonstrated in the lower picture in FIG. 9A highlighted with the arrows 2, 4, 6. This is easily distinguished from the more well-preserved and no damaged surface structure depicted in the lower picture in FIG. 9B for composition B103 composed with NbC.

Although the present disclosure has been described in connection with embodiments thereof, it will be appreciated by those skilled in the art that additions, deletions, modifications, and substitutions not specifically described may be made without departure from the spirit and scope of the disclosure as defined in the appended claims.

With respect to the use of substantially any plural and/or singular terms herein, those having skill in the art can translate from the plural to the singular and/or from the singular to the plural as is appropriate to the context and/or application. The various singular/plural permutations are not expressly set forth herein for sake of clarity.

The herein described subject matter sometimes illustrates different components contained within, or connected with, different other components. It is to be understood that such depicted architectures are merely exemplary, and that in fact many other architectures may be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected", or "operably coupled," to each other to achieve the desired functionality, and any two components capable of being so associated can also be viewed as being "operably couplable," to each other to achieve the desired functionality. Specific examples of operably couplable include but are not limited to physically mateable and/or physically interacting components, and/or wirelessly interactable, and/or wirelessly interacting components, and/or logically interacting, and/or logically interactable components.

In some instances, one or more components may be referred to herein as "configured to," "configured by," "configurable to," "operable/operative to," "adapted/adaptable," "able to," "conformable/conformed to," etc. Those skilled in the art will recognize that such terms (e.g., "configured to") can generally encompass active-state components and/or inactive-state components and/or standby-state components, unless context requires otherwise.

While particular aspects of the present subject matter described herein have been shown and described, it will be apparent to those skilled in the art that, based upon the teachings herein, changes and modifications may be made without departing from the subject matter described herein and its broader aspects and, therefore, the appended claims are to encompass within their scope all such changes and modifications as are within the true spirit and scope of the subject matter described herein. It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.).

It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to claims containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations.

In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations).

Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that typically a disjunctive word and/or phrase presenting two or more alternative terms, whether in the description, claims, or drawings, should be understood to contemplate the possibilities of including one of the terms, either of the terms, or both terms unless context dictates otherwise. For example, the phrase "A or B" will be typically understood to include the possibilities of "A" or "B" or "A and B."

With respect to the appended claims, those skilled in the art will appreciate that recited operations therein may generally be performed in any order. Also, although various operational flows are presented in a sequence(s), it should be understood that the various operations may be performed in other orders than those which are illustrated, or may be performed concurrently. Examples of such alternate orderings may include overlapping, interleaved, interrupted, reordered, incremental, preparatory, supplemental, simultaneous, reverse, or other variant orderings, unless context dictates otherwise. Furthermore, terms like "responsive to," "related to," or other past-tense adjectives are generally not intended to exclude such variants, unless context dictates otherwise.

Those skilled in the art will appreciate that the foregoing specific exemplary processes and/or devices and/or technologies are representative of more general processes and/or devices and/or technologies taught elsewhere herein, such as in the claims filed herewith and/or elsewhere in the present application.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

The illustrative embodiments described in the detailed description, drawings, and claims are not meant to be limiting. Other embodiments may be utilized, and other changes may be made, without departing from the spirit or scope of the subject matter presented here.

Where a range of values is provided, it is understood that each intervening value, to the tenth of the unit of the lower limit unless the context clearly dictates otherwise, between the upper and lower limit of that range and any other stated or intervening value in that stated range is encompassed within the disclosure. The upper and lower limits of these smaller ranges which can independently be included in the smaller ranges is also encompassed within the disclosure, subject to any specifically excluded limit in the stated range. Where the stated range includes one or both of the limits, ranges excluding either both of those included limits are also included in the disclosure.

One skilled in the art will recognize that the herein described components (e.g., operations), devices, objects, and the discussion accompanying them are used as examples for the sake of conceptual clarity and that various configuration modifications are contemplated. Consequently, as used herein, the specific exemplars set forth and the accompanying discussion are intended to be representative of their more general classes. In general, use of any specific exemplar is intended to be representative of its class, and the non-inclusion of specific components (e.g., operations), devices, and objects should not be taken as limiting.

Additionally, for example any sequence(s) and/or temporal order of sequence of the system and method that are described herein this disclosure are illustrative and should not be interpreted as being restrictive in nature. Accordingly, it should be understood that the process steps may be shown and described as being in a sequence or temporal order, but they are not necessarily limited to being carried out in any particular sequence or order. For example, the steps in such processes or methods generally may be carried out in various different sequences and orders, while still falling within the scope of the present disclosure.

Finally, the discussed application publications and/or patents herein are provided solely for their disclosure prior to the filing date of the described disclosure. Nothing herein should be construed as an admission that the described disclosure is not entitled to antedate such publication by virtue of prior disclosure.

What is claimed is:

1. A cemented carbide composition, comprising:

a hard phase comprising tungsten carbide (WC) as a first hard phase component and second hard phase components comprising tantalum carbide (TaC) present in an amount of from 3.3 wt. % to 9 wt. % based on a total weight of the cemented carbide composition and niobium carbide (NbC) present in an amount of from 18 wt. % to 20 wt. % based on a total weight of the cemented carbide composition; and a binder phase comprising at least one binder selected from the group consisting of cobalt (Co), nickel (Ni), and a mixture thereof.

2. The cemented carbide composition according to claim 1, further comprising a grain growth inhibitor.

3. The cemented carbide composition according to claim 2, wherein the grain growth inhibitor is molybdenum carbide ($Mo_2C$).

4. The cemented carbide composition according to claim 1, wherein the cemented carbide composition comprises from 69 wt. % to 74 wt. % of the WC as the first hard phase component based on a total weight of the cemented carbide composition.

5. The cemented carbide composition according to claim 1, wherein the cemented carbide composition comprises from 8 wt. % to 12 wt. % of the at least one binder based on a total weight of the cemented carbide composition.

6. The cemented carbide composition according to claim 2, wherein the cemented carbide composition comprises from 0.5 wt. % to 1.5 wt. % of the grain growth inhibitor based on a total weight of the cemented carbide composition.

7. The cemented carbide composition according to claim 1, wherein the cemented carbide composition has an HV30 Vickers hardness of from 1450 HV30 to 1600 HV30.

8. The cemented carbide composition according to claim 1, wherein the cemented carbide composition has a fracture toughness ($K_{Ic}$) of from 8.5 M Pa√m to 10 MPa√m.

9. A cemented carbide composition, comprising:

a hard phase comprising tungsten carbide (WC) as a hard phase, niobium carbide (NbC) present in an amount of from 18 wt. % to 20 wt. % based on a total weight of the cemented carbide composition as an anti-galling phase and tantalum carbide (TaC) present in an amount of from 3.3 wt. % to 9 wt. % based on a total weight of the cemented carbide composition as a toughness improver; and a binder phase comprising at least one binder selected from the group consisting of cobalt (Co), nickel (Ni), and a mixture thereof.

10. The cemented carbide composition according to claim 9, further comprising a grain growth inhibitor.

11. The cemented carbide composition according to claim 10, wherein the grain growth inhibitor is selected from the group consisting of molybdenum (Mo), molybdenum carbide (MoC), molybdenum carbide ($Mo_2C$), chromium carbide ($Cr_3C_2$), and mixtures thereof.

12. The cemented carbide composition according to claim 9, wherein the cemented carbide composition comprises the WC as a balance of the hard phase.

13. The cemented carbide composition according to claim 9, wherein the cemented carbide composition comprises from 4.3 wt. % to 9 wt. % of the TaC as the toughness improver based on a total weight of the cemented carbide composition.

14. The cemented carbide composition according to claim 9, wherein the cemented carbide composition comprises from 5 wt. % to 15 wt. % of the at least one binder based on a total weight of the cemented carbide composition.

15. The cemented carbide composition according to claim 10, wherein the cemented carbide composition comprises as the grain growth inhibitor, from 0.5 wt. % to 3 wt. % of at least one component selected from the group consisting of Mo, MoC, $Mo_2C$, and mixtures thereof based on a total weight of the cemented carbide composition, and optionally from 0.1 wt. % to 1.5 wt. % of $Cr_3C_2$ based on a total weight of the cemented carbide composition.

16. A tool, comprising the cemented carbide according to claim 1.

17. A tool, comprising the cemented carbide according to claim 9.

18. A method of making a cemented carbide, comprising:

providing a batch of powdered raw materials comprising tungsten carbide (WC) as a first hard phase component, a binder comprising at least one component selected from the group consisting of cobalt (Co), nickel (Ni), and a mixture thereof, second hard phase components comprising tantalum carbide (TaC) present in an amount of from 3.3 wt. % to 9 wt. % and niobium carbide (NbC) present in an amount of from 18 wt. % to 20 wt. %, and a grain growth inhibitor;

pressing the batch of powdered raw materials to form a pre-compact; and sintering the pre-compact.

* * * * *